US005624044A

United States Patent [19]

Black, Jr.

[11] Patent Number: 5,624,044

[45] Date of Patent: Apr. 29, 1997

[54] CUSTOMIZIBLE DISPLAY APPARATUS WITH PRINTED SIGNAGE

[75] Inventor: William H. Black, Jr., Edenton, N.C.

[73] Assignee: Tee-Lok Corporation, Edenton, N.C.

[21] Appl. No.: 444,159

[22] Filed: May 18, 1995

[51] Int. Cl.[6] ..... A47F 5/00

[52] U.S. Cl. ..... 211/186; 211/189; 40/642.02

[58] Field of Search ..... 292/251.5; 211/59.2, 211/134, 153, 180, 183, 186, 187, 189, 191, 195; 248/241, 247, 248, 299; 40/642; 312/234.1, 234.2, 234.3, 109; D6/396, 397, 436, 437, 449, 470, 479

[56] References Cited

U.S. PATENT DOCUMENTS

| | | | |
|---|---|---|---|
| 1,466,335 | 8/1923 | Gleason | 211/183 |
| 2,489,154 | 11/1949 | Relton | 292/251.5 |
| 2,775,352 | 12/1956 | Waite | 211/134 |
| 2,905,330 | 9/1959 | Lilja | 211/49 |
| 3,000,684 | 9/1961 | Shelly | 248/247 |
| 3,050,324 | 8/1962 | Faber | 292/251.5 |
| 3,276,804 | 10/1966 | Heppner | 292/251.5 |
| 3,308,961 | 3/1967 | Chesley | 211/49 |
| 3,312,492 | 4/1967 | Remhof | 292/251.5 |
| 3,634,986 | 1/1972 | Ford et al. | 52/316 |
| 4,040,194 | 8/1977 | Penton et al. | 40/142 |
| 4,248,931 | 2/1981 | Salman | 428/315 |
| 4,313,544 | 2/1982 | Ashton | 211/191 |
| 4,397,606 | 8/1983 | Bruton | 414/786 |
| 4,433,883 | 2/1984 | Boender et al. | 312/234.3 |
| 4,516,344 | 5/1985 | Seely | 40/602 |
| 4,643,787 | 2/1987 | Goodman | 156/196 |
| 4,783,921 | 11/1988 | George | 40/602 |
| 4,790,707 | 12/1988 | Magretta et al. | 211/187 |
| 4,997,094 | 3/1991 | Spamer et al. | 211/153 |
| 5,125,155 | 6/1992 | Kyle et al. | 29/897.32 |
| 5,181,623 | 1/1993 | Linden et al. | 211/183 |
| 5,220,944 | 6/1993 | Burnett et al. | 137/630.14 |

*Primary Examiner*—Robert W. Gibson, Jr.
*Attorney, Agent, or Firm*—Bell, Seltzer, Park & Gibson, P.A.

[57] ABSTRACT

A display apparatus comprises vertically spaced apart shelves for displaying a plurality of cartons containing various types and sizes of items, such as home building products. Interchangeable display cartons permit customizing individual displays. A pair of display signs made from tough, lightweight polymeric material, are movable between a closed position, in which the signs obscure from view items stored on the uppermost shelf of the display apparatus, and an open position, in which the uppermost shelf is accessible from the front of the display apparatus.

27 Claims, 2 Drawing Sheets

CUSTOMIZIBLE DISPLAY APPARATUS WITH PRINTED SIGNAGE

FIELD OF THE INVENTION

The present invention relates generally to retail display stands, and relates more particularly to display stands having display signage and shelves for supporting product cartons.

BACKGROUND OF THE INVENTION

Quite commonly, components used by home builders and "do-it-yourself" craftsmen are purchased at a hardware store or homebuilder's warehouse. Because home construction needs vary significantly from home to home, and even from repair to repair, typically manufacturers of home building components produce and sell a multiplicity of products in various sizes, whether the component is used in carpentry, plumbing, electrical work, or any of a number of other construction or repair fields. Products manufactured by the same manufacturer are generally displayed together on one or more display stands, which typically comprise horizontal shelves supported by vertical frame members. Most often, such shelves are about 8 feet in length and approximately 2 feet in depth and can be spaced vertically from each other to enable customers to identify and access products displayed thereon.

Above the uppermost shelf, extra products, product literature, or other items can be stored; these additional items are often hidden from the consumer's view by a pair of advertising signs displayed on the shelves that identifies the source of the goods and generally provides product information. Typically, each sign is formed of paper or cardboard and is mounted on a 4 foot by 4 foot square sheet of plywood. The outer edge of each plywood sheet is then attached by a pair of hinges to an outermost frame member. The hinged interconnection between the plywood sheets and the frame enables store personnel to access the items stored behind the sign.

This display configuration has certain shortcomings. The plywood sheets are included because the paper or cardboard signs themselves are insufficiently rigid to be self-supporting in a 4 foot by 4 foot square sheet when vertically disposed and hung by a side edge only. The plywood sheets are quite heavy; as a result, they require large hinges and are somewhat difficult to hang when the display is erected. In addition, the supplier of the goods, who is generally responsible for providing the signs, often ships the signs already attached to the plywood with the goods. As such, the signs are subjected to the same shipping, transport, and storage conditions as the goods themselves. These conditions may include being transported on a forklift or other relocating device. Plywood sheets have proven to be quite susceptible to breakage if subjected to sudden impact loads, particularly the type of load applied by a forklift ramming or spearing the plywood.

Another difficulty encountered by store personnel relates to the display of multiple related products from a common source. On many occasions, the supplier will provide display cartons that rest upon the display stand shelves and store multiple units of a particular product. The cartons, which are typically sized in direct relationship to the size of the product itself, are placed side-by-side on the shelves by store personnel, with vacant shelf space being minimized or eliminated entirely. Although it would be desirable to display the products in a manner that facilitates customer identification and access, often the cartons are sized so that they can be arranged on the shelves in only a few, or on some occasions only one, configuration that minimizes vacant shelf space. Such a display configuration prevents the shelf stocker from customizing the display to fit the needs of a particular store, which may differ considerably from the needs of a store in different geographic or socioeconomic area.

In view of the foregoing, it is an object of the present invention to provide a display apparatus having display signs that provide accessible storage space for undisplayed products and that are easily hung from conventional display shelving.

It is another object of the present invention to provide a display apparatus having display signs that are less prone to breakage during shipping, relocation within a store, and hanging.

It is an additional object of the present invention to provide a display apparatus having display cartons that enable store personnel to customize the display according to the needs of a particular store.

SUMMARY OF THE INVENTION

These and other objects are satisfied by the present invention, which as a first aspect relates to a display apparatus comprising a frame including a pair of upright support members, a plurality of generally horizontal elongate shelves, and a pair of generally vertically-oriented display signs. The frame includes upright support members having upper end portions that extend above the uppermost shelf for supporting the pair of display signs. Each display sign is pivotally interconnected to a respective one of the support member upper end portions at an outer edge portion and is movable between a closed position, in which both display signs are generally parallel and obscure from view items stored on the uppermost shelf, and an open position, in which each display sign is pivoted so that an inner edge portion moves forwardly and outwardly to enable the uppermost shelf to be accessed from the front side of the display apparatus. The display signs are formed of polymeric sheet material and each has printed indicia on a front side thereof, which generally identifies the source of the goods displayed. The display signs are sufficiently flexible to withstand impact loads, considerably lighter than conventional materials, and sufficiently rigid to be self-supporting when hung by their respective outer edge portions alone.

As a second aspect, the present invention comprises a display apparatus that includes a frame, a plurality of horizontal shelves, and a plurality of display cartons. The plurality of display cartons, which rest upon the horizontal shelves, are configured to receive displayed items therein. Each of the display cartons has a front wall with a predetermined width that is substantially identical to the predetermined widths of each of the other display cartons, and preferably a height that is substantially identical to each of the other cartons. Each of the cartons has a predetermined depth selected based on the size or shape of the items received therein. This display configuration enables the retailer to customize the arrangement of the cartons in a desired fashion.

BRIEF DESCRIPTION OF THE FIGURES

FIG. 4 is a view taken along lines 4—4 in FIG. 1 illustrating the cartons on one shelf of the display apparatus.

DETAILED DESCRIPTION OF THE PREFERRED EMBODIMENTS OF THE INVENTION

Figures 1, 2:
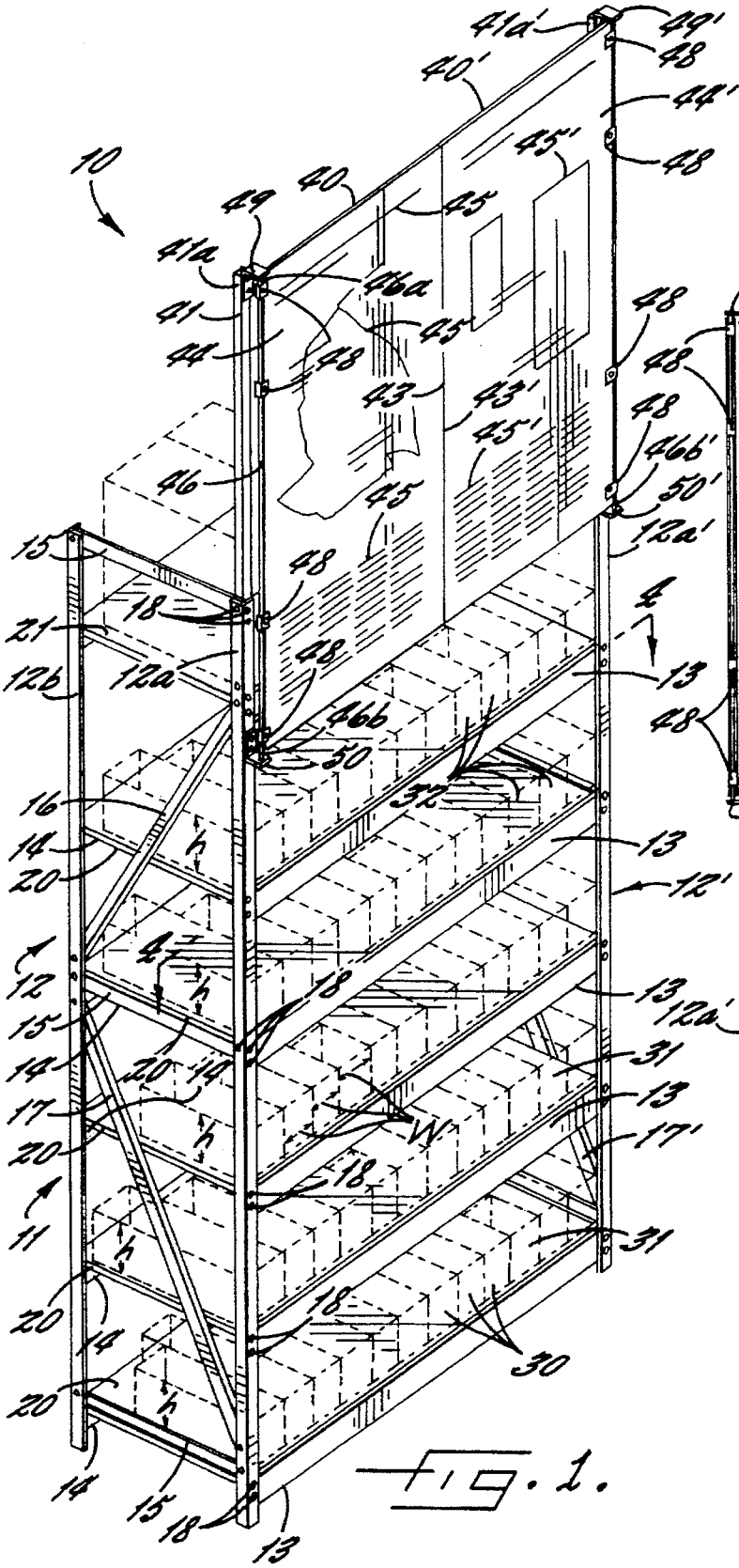
FIG. 1 is a perspective view of the display apparatus according to the present invention.
FIG. 2 is a side elevation view of the display apparatus of FIG. 1.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout.

Referring to FIGS. 1 through 4, a display apparatus, generally designated at 10, is illustrated. The display apparatus 10 includes a frame 11, horizontal display shelves 20 connected to the frame, display cartons 30, an upper storage shelf 21 connected to the frame, and a pair of hinged display signs 40,40'.

The frame 11 (FIGS. 1 and 2) includes two opposing pairs of vertical support members 12,12', each pair comprised of a front vertical support member 12*a*, 12*a'* and a rear vertical support member 12*b*,12*b'*. The opposing pairs of vertical support members 12,12' are joined by front horizontal support members 13 and by rear horizontal support members 14. The front and rear vertical support members 12*a*, 12*b* are joined by a lateral support member 15; similarly, the front and rear support members 12*a'*, 12*b'* are joined by a lateral support member 15'. To provide support for the shelves 20, each front support member 13 is positioned relative to the vertical support members 12, 12' at substantially the same height as that of a lateral support member 15, a lateral support member 15', and a rear horizontal support member 14. Each pair of vertical support members 12, 12' also includes an upper diagonal support 16,16' and a lower diagonal support 17,17'.

In the illustrated embodiment, the vertical support members 12*a*, 12*a'*, 12*b*, 12*b'* are struts of L-shaped cross-section having a plurality of holes 18 spaced apart along each of the faces of each member. The horizontal, lateral, and diagonal support members 13, 14, 15, 15', 16, 16', 17, 17' preferably have holes adjacent each end, and the frame 11 is constructed by connecting the horizontal, lateral, and diagonal support members to the vertical support members 12*a*, 12*b*, 12*a'*, 12*b'* through conventional means such as threaded bolts and correspondingly threaded nuts. As would readily be understood by those having skill in the art, other suitable means of assembling the frame may be used. Preferably all frame members are metal; however, they may be formed of any suitably strong and rigid material such as wood, plastic, or a composite material.

Referring still to FIGS. 1 and 2, generally rectangular, horizontally disposed display shelves 20 are supported by a level set of front and rear horizontal support members 13, 14 and lateral support members 15, 15'. The shelves 20 are vertically spaced apart to accommodate the display cartons 30 placed thereon. A generally rectangular, horizontally-disposed upper storage shelf 21 is provided in the uppermost portion of frame 11 above the display shelves 20. Preferably, the display shelf 21 and storage shelves 20 are between 7.5 and 8.5 feet, and more preferably 8 feet, in length, and approximately 2 feet in depth. (i.e., the shelf preferably measures approximately 2 feet from its front edge adjacent a front support member 13 to a rear edge adjacent a rear support member 14). The display shelf 21 and storage shelves 20 may comprise metal, wood, plastic, or any other material of sufficient strength and rigidity to support the displayed items.

In the illustrated embodiment, display cartons 30 are arranged side-by-side on each display shelf 20 (FIGS. 1 and 4). Each display carton 30 is a generally rectangular box for storing and displaying various types and sizes of items, such as home building products. In the preferred embodiment, each display carton 30 is formed of cardboard; however, the display cartons 30 may be formed of any suitable material or combination of materials including wood, metal, or plastic. Preferably, the front wall 31 of each display carton 30 includes printed indicia 32 for providing information about the items contained within the display carton.

In the illustrated embodiment, the width w of the front wall 31 of each display carton 30 on a particular display apparatus 10 is substantially the same as the width of the front walls 31 of the other display cartons 30 (FIG. 1). Preferably, the width w of each front wall 31 is such that when the display cartons are arranged in side-by-side relationship along the full length of each display shelf 20, essentially no vacant shelf space remains. For example, if the length of a display shelf 20 is 96 inches (i.e., 8 feet), it would be preferable for each front wall 31 to have a width w where 96 is approximately evenly divisible by w, such as 1.5, 2, 4, 6, 8 or 12 inches.

To accommodate the different sizes and types of items contained within each display carton 30, the depth d of each display carton 30 is nonuniform relative to the other cartons 30. As illustrated in FIG. 4, each display shelf 20 has sufficient depth to accommodate display cartons 30 having nonuniform depths. By maintaining the width w of each display carton 30 constant and varying the depth d to accommodate the contents, the display cartons 30 may be arranged in any order on any shelf 20 as desired and can be interchanged with any other display carton 30. Consequently, the same number of display cartons 30 will fit at any location on any display shelf 20 regardless of the contents of each display carton 30, thereby enabling the retailer to customize the arrangement of the cartons 30 of the display apparatus 10 to fit the needs of a particular store.

Preferably, the height h of each front wall 31 is substantially the same as each of the other front walls 31, thereby providing each of the front walls 31 with substantially equal frontal area (FIG. 2). As a result, the display shelves 20 can be vertically spaced apart equally, which provides a pleasing appearance, and each display carton 30 can be placed on any display shelf.

Figures 2, 3:
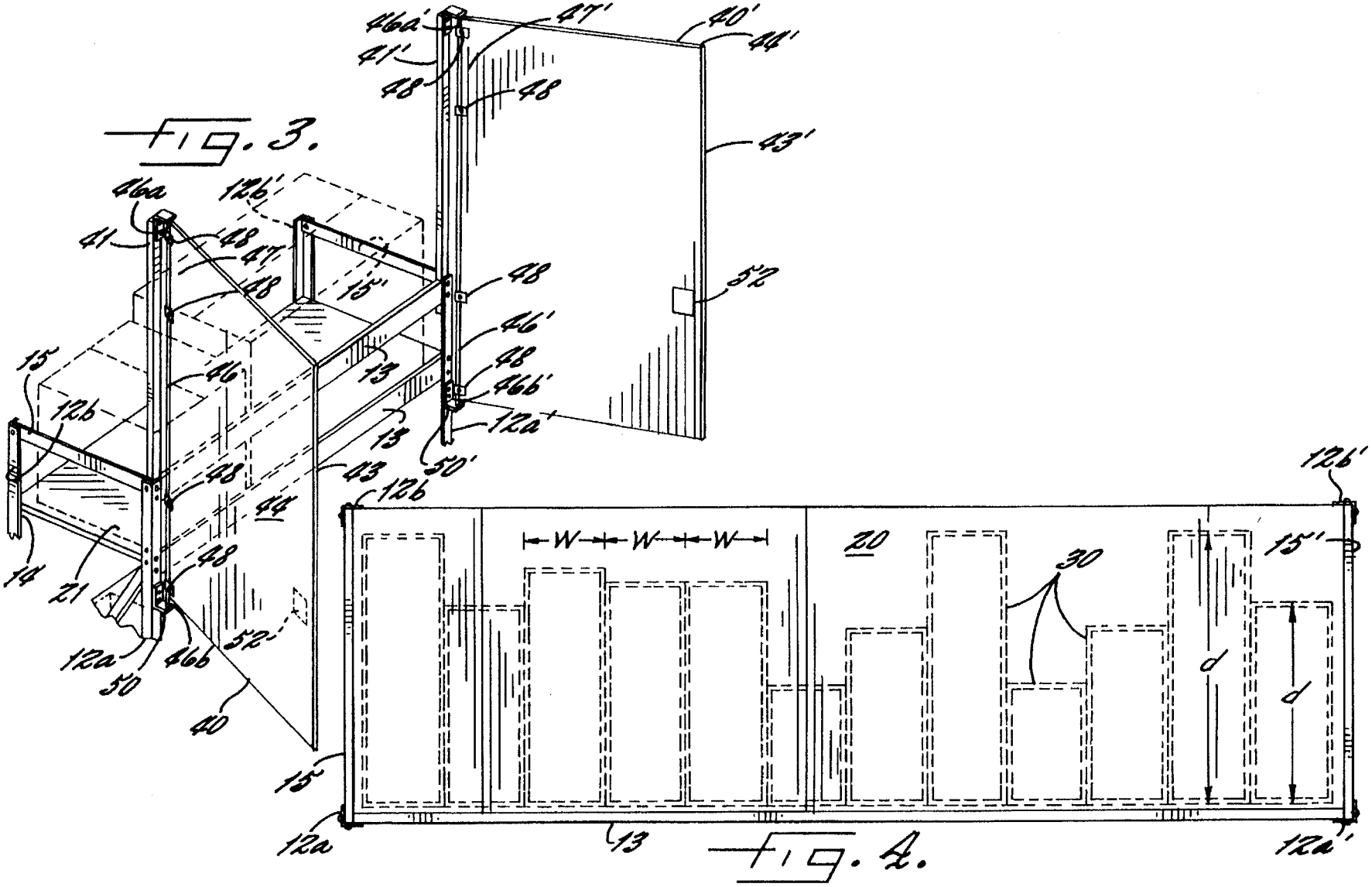
FIG. 3 is a fragmentary perspective view of the display apparatus of FIG. 1 illustrating the hinged display signs in their open positions.

The frame 11 includes a pair of upright support members 41,41' connected to and extending upwardly from the front vertical support members 12*a*,12*a'* (FIGS. 1 and 3). Each of the upright support members 41,41' supports a respective one of the pair of hinged display signs 40,40'. The upright support members 41,41' are preferably metal struts; however, they may be formed of any material having sufficient strength and rigidity to support the display signs 40,40'. A rod 46,46' is secured to the vertical outer edge portion 47,47' of each display sign 40,40' via fasteners 48. The upper end portion 46*a*,46*a'* of each rod 46,46' pivotally engages an upper bracket 49,49' attached to an upper portion 41*a*,41*a'* of each upright support member 41,41'. The lower end portion 46*b*,46*b'* of each rod 46,46' pivotally engages a lower bracket 50,50' attached to each front vertical support member 12*a*,12*a*'. As a result, each display sign 40, 40' is free to pivot about a substantially vertical pivot axis defined by its corresponding rod 46,46'.

The storage shelf 21 of the display apparatus 10 is typically used to store extra products, product literature, or other items. When in a closed position, the display signs 40,40' obscure from view the items stored on the storage shelf 21 and permit forward access thereto (i.e. access to a user positioned in front of the display apparatus 10) when in an open position. The display signs 40,40' are preferably generally square and are pivotally attached to the frame 11.

In a preferred embodiment, the display signs 40,40' are made from 0.100 inch thick polystyrene sheets and are approximately 4 feet by 4 feet in height and length. This height and width enable the display signs 40,40' to obscure virtually all items stored there behind from view. Polystyrene having a thickness of about 0.100 inch is preferred because it is sufficiently light yet rigid to be self-supporting when supported along a vertical edge only, yet it is sufficiently impact-resistant and flexible to withstand impact and abuse from a rigorous working environment. Although polystyrene or other polymeric sheet material having a modulus of elasticity of between about 200,000 and 320,000 pounds per square inch and a specific gravity of between about 1.01 and 1.08 is preferred, any polymeric sheet material having a modulus of elasticity, a thickness, and a density selected so that the display sign is self-supporting when hung vertically by a side edge can be used with the present invention. Also, preferably, printed indicia 45,45' is printed directly onto the front sides 44,44' of each of the display signs 40,40'. Direct printing eliminates the prior art steps of attaching paper or cardboard to a separate plywood sheet.

When in the closed position, the display signs 40,40' are positioned to be generally parallel (FIG. 1), with the inner edge portions 43,43' of each display sign 40,40' being adjacent to the inner edge portion of the other display sign 40',40. Preferably, the display signs 40,40' are retained in the closed position via a magnetic closure device or other fastener 52.

Access to the storage shelf 21 is gained by pivoting the inner edge portions 43,43' of the display signs 40,40' relative to the frame 11 (FIG. 3) to an open position, in which the inner edge portions 43,43' of the display signs 40, 40' move forwardly and outwardly from their respective closed positions. Once one or both display signs 40, 40' are in their open positions; items stored on the horizontal support shelf 21 can be forwardly accessed and retrieved.

The foregoing embodiments are illustrative of the present invention, and are not to be construed as limiting thereof. The invention is defined by the following claims, with equivalents of the claims to be included therein.

That which is claimed is:

1. A display apparatus comprising:

a frame including a pair of upright support members;

a plurality of generally horizontal elongate shelves connected with said frame, said shelves being vertically spaced apart from each other;

wherein said upright support members have upper end portions extending above an uppermost one of said shelves; and a pair of generally vertically-oriented frameless display signs, each of which is pivotally interconnected to a respective upright support member upper end portion, via pivotal interconnection means such that each respective display sign is pivotable between a closed position, in which said display signs are generally parallel and obscure from view items stored on said uppermost shelf, and an open position, in which each respective display sign is pivoted so that an inner edge portion moves forwardly and outwardly to enable said uppermost shelf to be forwardly accessed;

said display signs being formed of polymeric sheet material and having printed indicia on a front side thereof.

2. The display apparatus defined in claim 1, wherein each of said display signs comprises a sheet material that is substantially square.

3. The display apparatus defined in claim 1, wherein each of said display signs comprises a sheet material having length and height dimensions of about 4 feet.

4. The display apparatus defined in claim 1, wherein said display signs are formed of material having a modulus of elasticity of between about 200,000 and 320,000 pounds per square inch and a density of between about 1.01 and 1.08.

5. The display apparatus defined in claim 1, wherein said polymeric sheet material comprises polystyrene.

6. The display apparatus defined in claim 1, wherein each of said display signs has a thickness of approximately 0.100 inches.

7. The display apparatus defined in claim 1, wherein each of said display signs is sized so that, when each display sign is in its closed position, an inner edge portion of each sign is adjacent an inner edge portion of the other sign of the pair.

8. The display apparatus defined in claim 1, wherein said upright support member upper end portions are separated from each other by between about 7.5 and 8.5 feet.

9. The display apparatus defined in claim 1, further comprising sign-retaining means attached to said display signs for retaining said display signs in their respective closed positions.

10. The display apparatus defined in claim 9, wherein said sign-retaining means comprises magnetic means attached to said display signs.

11. The display apparatus defined in claim 1, wherein said printed indicia is printed directly onto said front sides of said display signs.

12. A display apparatus comprising:

a frame including a pair of upright support members;

a plurality of generally horizontal elongate shelves connected with said frame, said shelves being vertically spaced apart from each other;

wherein said upright support members have upper end portions extending above an uppermost one of said shelves; and a pair of generally vertically-oriented frameless display signs, each of which is pivotally interconnected to a respective upright support member upper end portion via pivotal interconnection means, such that each respective display sign is pivotable between a closed position, in which said display signs are generally parallel and obscure from view items stored on said uppermost shelf, and an open position, in which said display sign is pivoted so that an inner edge portion moves forwardly and outwardly to enable said uppermost shelf to be forwardly accessed;

said display signs being formed of polymeric sheet material and having printed indicia on a front side thereof, the thickness, density and modulus of elasticity of the polymeric sheet material being chosen so that said display signs remain erect when supported only by said side edge.

13. A display apparatus comprising:

a frame including a pair of upright support members;

a plurality of generally horizontal elongate shelves connected with said frame, said shelves being vertically spaced apart from each other;

wherein said upright support members have upper end portions extending above an uppermost one of said shelves;

a pair of generally vertically-oriented frameless display signs, each of which is pivotally interconnected to a respective upright support member upper end portion via pivotal interconnection means, such that each respective display sign is pivotable between a closed position, in which said display signs are generally parallel and obscure from view items stored on said uppermost shelf, and an open position, in which said display sign is pivoted so that an inner edge portion moves forwardly and outwardly to enable said uppermost shelf to be forwardly accessed;

said display signs being formed of polymeric sheet material and having printed indicia on a front side thereof; and a plurality of display cartons configured to receive displayed items therein resting upon said shelves, each of said display cartons having a front wall with a predetermined width that is substantially identical to the predetermined widths of each of said front walls of the other display cartons, and wherein each of said cartons has a predetermined depth selected based on the items received therein, the depth of said cartons being non-uniform.

14. The display apparatus defined in claim 13, wherein each of said display signs comprises a sheet material that is substantially square.

15. The display apparatus defined in claim 13, wherein each of said display signs comprises a sheet material having length and height dimensions of about 4 feet.

16. The display apparatus defined in claim 13, wherein said display signs are formed of material having a modulus of elasticity of between about 200,000 and 320,000 pounds per square inch and a density of between about 1.01 and 1.08.

17. The display apparatus defined in claim 13, wherein said polymeric sheet material comprises polystyrene.

18. The display apparatus defined in claim 13, wherein each of said display signs has a thickness of approximately 0.100 inches.

19. The display apparatus defined in claim 13, wherein each of said display signs is sized so that, when each display sign is in its closed position, an inner edge portion of each sign is adjacent an inner edge portion of the other sign of the pair.

20. The display apparatus defined in claim 13, wherein said upright support member upper end portions are separated from each other by between about 7.5 and 8.5 feet.

21. The display apparatus defined in claim 13, further comprising sign-retaining means attached to said display signs for retaining said display signs in their respective closed positions.

22. The display apparatus defined in claim 21, wherein said sign-retaining means comprises magnetic means attached to said display signs.

23. The display apparatus defined in claim 13, wherein said printed indicia is printed directly onto said front sides of said display signs.

24. The display apparatus defined in claim 13, wherein each of said display carton front walls has a predetermined height that is substantially identical to the predetermined height of the other display cartons.

25. The display apparatus defined in claim 13, wherein said predetermined width of each of said front walls of said cartons is selected so that, when a preselected group of said cartons is placed on one of said shelves in adjacent contacting relationship, with said front walls being substantially parallel, said cartons occupy substantially the entire length of said shelf such that said shelf is free of vacant shelf space.

26. The display apparatus defined in claim 25, wherein said predetermined width of each of said front walls of said display cartons is between about 7 and 9 inches.

27. The display apparatus defined in claim 26, wherein said shelves are between about 7.5 and 8.5 feet in length.

* * * * *